US011236446B2

(12) United States Patent
Nakai et al.

(10) Patent No.: US 11,236,446 B2
(45) Date of Patent: Feb. 1, 2022

(54) COMMINGLED YARN, METHOD FOR MANUFACTURING THE COMMINGLED YARN, AND, WEAVE FABRIC

(71) Applicant: Mitsubishi Gas Chemical Company, Inc., Tokyo (JP)

(72) Inventors: Asami Nakai, Gifu (JP); Akio Ootani, Gifu (JP); Masataka Kaji, Ishikawa (JP); Mitsuro Takagi, Ishikawa (JP); Nobuhiko Matsumoto, Kanagawa (JP); Jun Mitadera, Kanagawa (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 788 days.

(21) Appl. No.: 15/028,536

(22) PCT Filed: Oct. 10, 2014

(86) PCT No.: PCT/JP2014/077148
§ 371 (c)(1),
(2) Date: Apr. 11, 2016

(87) PCT Pub. No.: WO2015/056642
PCT Pub. Date: Apr. 23, 2015

(65) Prior Publication Data

US 2016/0237597 A1 Aug. 18, 2016

(30) Foreign Application Priority Data

Oct. 18, 2013 (JP) ..... JP2013-217035
Sep. 18, 2014 (JP) ..... JP2014-189685

(51) Int. Cl.
*D02G 3/04* (2006.01)
*D06M 15/59* (2006.01)
(Continued)

(52) U.S. Cl.
CPC ..... *D02G 3/04* (2013.01); *D01F 6/60* (2013.01); *D02G 3/16* (2013.01); *D02G 3/36* (2013.01);
(Continued)

(58) Field of Classification Search
CPC .. D02G 3/16; D02G 3/04; D02G 3/36; D02G 3/40; D01F 6/60; D06M 13/513;
(Continued)

(56) References Cited

U.S. PATENT DOCUMENTS 3,175,351 A 3/1965 Bloch
3,436,797 A 4/1969 Graf et al.
(Continued)

FOREIGN PATENT DOCUMENTS

CN 1537188 A 10/2004
CN 101736593 A 6/2010
(Continued)

OTHER PUBLICATIONS

International Search Report dated Dec. 9, 2014 for PCT/JP2014/077148 and English translation of the same.
(Continued)

*Primary Examiner* — Holly Rickman
*Assistant Examiner* — Linda N Chau
(74) *Attorney, Agent, or Firm* — Fitch, Even, Tabin & Flannery LLP

(57) ABSTRACT

Provided is a commingled yarn having a dispersing property and having a smaller amount of voids, a method for manufacturing the commingled yarn, and a weave fabric using the commingled yarn. The commingled yarn comprises a continuous thermoplastic resin fiber, a continuous reinforcing fiber, and a surface treatment agent and/or sizing agent, comprises the surface treatment agent and/or sizing agent in a content of 2.0% by weight or more, relative to a total
(Continued)

amount of the continuous thermoplastic resin fiber and the continuous reinforcing fiber, and has a dispersibility of the continuous thermoplastic resin fiber and the continuous reinforcing fiber of 70% or larger.

6 Claims, 1 Drawing Sheet

(51) Int. Cl.

| | |
|---|---|
| ***D06M 15/564*** | (2006.01) |
| ***D06M 15/55*** | (2006.01) |
| ***D06M 13/513*** | (2006.01) |
| ***D02G 3/16*** | (2006.01) |
| ***D02G 3/40*** | (2006.01) |
| ***D01F 6/60*** | (2006.01) |
| ***D02G 3/36*** | (2006.01) |
| *D06M 101/34* | (2006.01) |
| *D06M 101/36* | (2006.01) |

(52) U.S. Cl.
CPC ..... *D02G 3/40* (2013.01); *D06M 13/513* (2013.01); *D06M 15/55* (2013.01); *D06M 15/564* (2013.01); *D06M 15/59* (2013.01); *D06M 2101/34* (2013.01); *D06M 2101/36* (2013.01); *D10B 2101/06* (2013.01); *D10B 2101/12* (2013.01); *D10B 2331/02* (2013.01); *D10B 2505/02* (2013.01)

(58) Field of Classification Search
CPC .... D06M 15/55; D06M 15/564; D06M 15/59; D06M 2101/34; D06M 2101/36; D10B 2101/06; D10B 2101/12; D10B 2331/02; D10B 2505/02
See application file for complete search history.

(56) References Cited

U.S. PATENT DOCUMENTS

| | | | | |
|---|---|---|---|---|
| 4,528,223 | A | 7/1985 | Kumazawa et al. | |
| 5,989,710 | A | 11/1999 | Matsuo et al. | |
| 6,051,316 | A * | 4/2000 | Boissonnat | C03C 25/26 428/378 |
| 7,135,516 | B2 | 11/2006 | Sugiura et al. | |
| 2004/0197555 | A1 | 10/2004 | Sugiura et al. | |
| 2011/0129647 | A1 | 6/2011 | Duke, Jr. et al. | |
| 2013/0062806 | A1 * | 3/2013 | Mitadera | C08J 5/24 264/129 |
| 2014/0228481 | A1 | 8/2014 | Inoue et al. | |
| 2014/0256855 | A1 | 9/2014 | Wakabayashi et al. | |
| 2016/0032082 | A1 | 2/2016 | Matsumoto et al. | |

FOREIGN PATENT DOCUMENTS

| | | | |
|---|---|---|---|
| EP | 2963165 | A1 | 1/2016 |
| JP | S60209034 | A | 10/1985 |
| JP | H3-33237 | A | 2/1991 |
| JP | H9-324331 | A | 12/1997 |
| JP | H09324331 | A | 12/1997 |
| JP | 2001-303456 | A | 10/2001 |
| JP | 2003-268674 | A | 9/2003 |
| JP | 2005-146431 | A | 6/2005 |
| JP | 2005-179829 | A | 7/2005 |
| JP | 2013-237945 | A | 11/2013 |
| WO | 2003/012188 | A1 | 2/2003 |
| WO | 2004/080698 | A1 | 9/2004 |
| WO | 2013/027708 | A1 | 2/2013 |
| WO | 2013/042367 | A1 | 3/2013 |
| WO | 2014/132776 | A1 | 9/2014 |

OTHER PUBLICATIONS

Partial Supplementary European Search Report dated Jun. 8, 2017 issued in corresponding European Patent Ppplication No. 14853602.2 (25 pages).
Search Report dated Apr. 4, 2018 issued in the corresponding Russian Patent Application No. 2016118763.
International Preliminary Report On Patentability dated Apr. 19, 2016 for PCT/JP2014/077148 and English translation of the same (14 pages).
Official Action dated Dec. 8, 2015, issued in corresponding Canadian Patent Application No. 2,904,496 (5 pages).
Official Action dated Jun. 20, 2016, issued in corresponding Chinese Patent Application No. 201480013850.3 (5 pages).

* cited by examiner

COMMINGLED YARN, METHOD FOR MANUFACTURING THE COMMINGLED YARN, AND, WEAVE FABRIC

CROSS-REFERENCE TO RELATED APPLICATIONS

This application is a U.S. national phase application filed under 35 U.S.C. § 371 of International Application PCT/JP2014/077148 filed on Oct. 10, 2014, designating the United States, which claims priority from Japanese Application Number 2013-217035, filed Oct. 18, 2013, and Japanese Application Number 2014-189685, filed Sep. 18, 2014, which are hereby incorporated herein by reference in their entirety.

TECHNICAL FIELD

This invention relates a commingled yarn using a thermoplastic resin fiber and a continuous reinforcing fiber, and a method for manufacturing the commingled yarn. This invention also relates to a weave fabric using the commingled yarn.

BACKGROUND ART

It has been practiced that continuous carbon fibers are bundled by using surface treatment agent or sizing agent (Patent Literature 1, Patent Literature 2). When the continuous carbon fibers bundled, problems to be encountered now include sizability, dispersing property, density and so forth.

CITATION LIST

Patent Literature

[Patent Literature 1] JP-A-2003-268674
[Patent Literature 2] International Patent WO2003/012188, pamphlet

SUMMARY OF THE INVENTION

It was, however, found that the commingled yarn, when manufactured by using the continuous thermoplastic resin fiber and the continuous reinforcing fiber, with an increased amount of the surface treatment agent or sizing agent (may occasionally be referred to as "surface treatment agent, etc."), was improved in the sizability, but degraded in the dispersing property of the continuous reinforcing fiber in the commingled yarn. Meanwhile, the commingled yarn, when manufactured with a reduced amount of surface treatment agent, was improved in the dispersing property of the continuous reinforcing fiber, but often resulted in falling of the fiber from commingled yarn, and became more difficult to be bundled suitably. Even if bundled in any way, it was found that the commingled yarn tends to produce voids therein, and tends to degrade in the mechanical strength when molded.

It is therefore an object of the present invention to solve the problems described above, and to provide a commingled yarn which contains the continuous reinforcing fiber in a highly dispersed manner, and has only a small amount of voids.

After studies under such situation by the present inventors, the problems described above were solved by the means [1] below, and preferably by means [2] to [17] below.

[1] A commingled yarn comprising a continuous thermoplastic resin fiber, a continuous reinforcing fiber, and a surface treatment agent and/or sizing agent; wherein the commingled yarn comprises the surface treatment agent and/or sizing agent in a content of 2.0% by weight or more, relative to a total amount of the continuous thermoplastic resin fiber and the continuous reinforcing fiber, and has a dispersibility of the continuous thermoplastic resin fiber and the continuous reinforcing fiber of 70% or larger.

[2] The commingled yarn of [1], having a void ratio of 20% or smaller.

[3] The commingled yarn of [1] or [2], comprising at least two or more species of the surface treatment agent and/or sizing agent.

[4] The commingled yarn of any one of [1] to [3], wherein the continuous thermoplastic resin fiber contains a polyamide resin.

[5] The commingled yarn of any one of [1] to [3], wherein the continuous thermoplastic resin fiber contains at least one species selected from polyamide 6, polyamide 66 and xylylene diamine-based polyamide resin.

[6] The commingled yarn of [5], wherein the xylylene diamine-based polyamide resin contains a diamine structural unit and a dicarboxylic acid structural unit; 70 mol % or more of the diamine structural unit is derived from xylylene diamine; and 50 mol % or more of the dicarboxylic acid structural unit is derived from sebacic acid.

[7] The commingled yarn of any one of [1] to [6], wherein the continuous reinforcing fiber is a carbon fiber and/or glass fiber.

[8] The commingled yarn of any one of [1] to [7], wherein at least one species of the surface treatment agent and/or sizing agent is selected from epoxy resin, urethane resin, silane coupling agent, water-insoluble nylon and water-soluble nylon.

[9] The commingled yarn of any one of [1] to [7], wherein at least one species of the surface treatment agent and/or sizing agent is selected from epoxy resin, urethane resin, silane coupling agent and water-soluble nylon.

[10] The commingled yarn of any one of [1] to [9], wherein at least one species of the surface treatment agent and/or sizing agent is water-soluble nylon.

[11] The commingled yarn of any one of [1] to [10], wherein the surface treatment agent and/or sizing agent has a content of 2.0 to 10% by weight, relative to a total amount of the continuous thermoplastic resin fiber and the continuous reinforcing fiber.

[12] A method for manufacturing a commingled yarn, the method comprising immersing a blended fiber bundle into a liquid containing a surface treatment agent and/or sizing agent, followed by drying, wherein the blended fiber bundle comprises a continuous thermoplastic resin fiber, a continuous reinforcing fiber, and a surface treatment agent and/or sizing agent; and the surface treatment agent and/or sizing agent has a content of 0.1 to 1.5% by weight, relative to a total amount of the continuous thermoplastic resin fiber and the continuous reinforcing fiber.

[13] The method for manufacturing a commingled yarn of [12], wherein the continuous reinforcing fiber is a carbon fiber and/or glass fiber.

[14] The method for manufacturing a commingled yarn of [12] or [13], wherein at least one species of the surface treatment agent and/or sizing agent is selected from epoxy resin, urethane resin, silane coupling agent, water-insoluble nylon and water-soluble nylon.

[15] The method for manufacturing a commingled yarn of any one of [12] to [14], wherein the surface treatment agent and/or sizing agent contained in the blended fiber bundle, has a main ingredient different from a main ingredient of the liquid containing a surface treatment agent and/or sizing agent.

[15] The method for manufacturing a commingled yarn of any one of [12] to [14], wherein the surface treatment agent and/or sizing agent contained in the blended fiber bundle has a main ingredient different from a main ingredient of the liquid containing a surface treatment agent and/or sizing agent.

[16] The method for manufacturing a commingled yarn of any one of [12] to [15], wherein the commingled yarn is the commingled yarn described in any one of [1] to [11].

[17] A weave fabric obtainable by using the commingled yarn described in any one of [1] to [11], or using the commingled yarn obtainable by the method for manufacturing a commingled yarn described in any one of [12] to [16].

According to this invention, it becomes now possible to provide a commingled yarn having a high dispersing property of the continuous reinforcing fiber, only with a small amount of voids.

DESCRIPTION OF EMBODIMENTS

Figure 1:
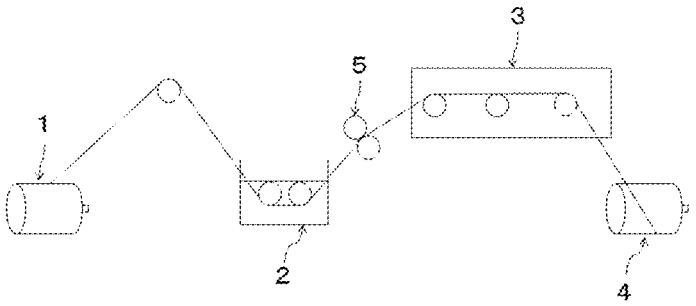
FIG. 1 A conceptual drawing illustrating an exemplary method for manufacturing a commingled yarn.

This invention will be detailed below. Note that all numerical ranges denoted by using "to", preceded and succeeded by numerals, include these numerals as the lower limit value and the upper limit value. The main ingredient in the context of this invention means an ingredient whose amount of mixing is largest in a certain composition or component, typically means an ingredient which accounts for 50% by weight or more of a specific composition or the like, and preferably accounts for 70% by weight or more of a specific composition or the like.

Nylon in the context of this invention means polyamide resin.

The commingled yarn of this invention is characterized in that the commingled yarn contains a continuous thermoplastic resin fiber, a continuous reinforcing fiber, and a surface treatment agent and/or sizing agent, wherein the total content of the surface treatment agent and/or sizing agent is 2.0% by weight or more relative to the total amount of the continuous thermoplastic resin fiber and the continuous reinforcing fiber, and the dispersibility of the continuous thermoplastic resin fiber and the continuous reinforcing fiber is 70% or larger.

The commingled yarn, when manufactured by using the continuous thermoplastic resin fiber and the continuous reinforcing fiber, only with a small amount of the surface treatment agent, etc., has been improved in the dispersibility of the continuous thermoplastic resin fiber and the continuous reinforcing fiber in the resultant commingled yarn, but has been more likely to cause falling of the fiber from the commingled yarn, more difficult to be bundled suitably, and more likely to produce therein much voids. In particular, with a large amount of voids, the commingled yarn has reduced the mechanical strength of a composite material obtained by process under heating. This invention has succeeded at providing a commingled yarn having only a small amount of voids while keeping a high dispersibility, by making the continuous thermoplastic resin fiber and the continuous reinforcing fiber into a blended fiber bundle using a small amount of surface treatment agent, and then by further treating the blended fiber bundle with the surface treatment agent, etc.

The surface treatment agent, etc. in the commingled yarn of this invention conceptually include the case where apart thereof, or the entire portion thereof, has been reacted with other ingredient in the commingled yarn such as the surface treatment agent or the thermoplastic resin.

Shape of the commingled yarn of this invention is not specifically limited so long as the continuous thermoplastic resin fiber and the continuous reinforcing fiber are bundled therein using the surface treatment agent, etc., and includes various shapes such as tape, and fiber having circular cross section. The commingled yarn of this invention preferably has a tape-like form.

The total content of the surface treatment agent, etc. is defined by a measured value obtainable from the measurement described later in EXAMPLE.

The void ratio of the commingled yarn of this invention is preferably 20% or less, and more preferably 19% or less. The lower limit value of the void ratio may be 0%, without special limitation. The void ratio in this invention is defined by a measured value obtainable from the measurement described later in EXAMPLE.

The ratio of the total fineness of the continuous thermoplastic resin fiber used for manufacturing a single commingled yarn, and the total fineness of the continuous reinforcing fiber (total fineness of continuous thermoplastic resin fiber/total fineness of continuous reinforcing fiber) is preferably 0.1 to 10, more preferably 0.1 to 6.0, and even more preferably 0.8 to 2.0.

The total number of fibers used for manufacturing a single commingled yarn (the number of fibers obtained by summation of the total number of fibers of the continuous thermoplastic resin fiber and the total number of fibers of the continuous reinforcing fiber) is preferably 100 to 100000 f, more preferably 1000 to 100000 f, even more preferably 1500 to 70000 f, yet more preferably 2000 to 20000 f, particularly 2500 to 10000 f, and most preferably 3000 to 5000 f. Within these ranges, the commingled yarn will be improved in the commingling ability, and will be improved in the physical properties and texture as a composite material. There will be less domain where either fiber will unevenly be abundant, instead allowing more uniform dispersion of both fibers.

The ratio of the total number of fibers of the continuous thermoplastic resin fiber and the total number of fibers of the continuous reinforcing fiber (total number of fibers of continuous thermoplastic resin fiber/total number of fibers of continuous reinforcing fiber), used for manufacturing a single commingled yarn, is preferably 0.001 to 1, more preferably 0.001 to 0.5, and even more preferably 0.05 to 0.2. Within these ranges, the commingled yarn will be improved in the commingling ability, and will be improved in the physical properties and texture as a composite material. In the commingled yarn, it is preferable that the continuous thermoplastic resin fiber and the continuous reinforcing fiber are mutually dispersed in a more uniform manner. Again within these ranges, the fibers are likely to mutually disperse in a more uniform manner.

In the commingled yarn of this invention, the dispersibility of the continuous thermoplastic resin fiber and the continuous reinforcing fiber is preferably 60 to 100%, more preferably 70 to 100%, and particularly 80 to 100%. Within these ranges, the commingled yarn will demonstrate more uniform physical properties, and this shortens the molding time, and improves appearance of the molded article. In addition, the molded article obtained by using the commingled yarn will be more improved in the mechanical properties.

The dispersibility in this invention is an index which indicates how uniformly the continuous thermoplastic resin fiber and the continuous reinforcing fiber are dispersed in the commingled yarn, and is defined by a measured value obtained by the method described later in EXAMPLE.

The larger the dispersibility, the more uniformly the continuous thermoplastic resin fiber and the continuous reinforcing fiber disperse.

<Continuous Thermoplastic Resin Fiber>

The continuous thermoplastic resin fiber used in this invention is typically a continuous thermoplastic resin fiber in which a plurality of fibers are made into a bundle. The continuous thermoplastic resin fiber bundle is used to manufacture the commingled yarn of this invention.

The continuous thermoplastic resin fiber in this invention is defined by thermoplastic resin fiber having a length exceeding 6 mm. While the average fiber length of the continuous thermoplastic resin fiber used in this invention is not specifically limited, it preferably falls in the range from 1 to 20,000 m from the viewpoint of improving the formability, more preferably 100 to 1,0000 m, and even more preferably 1,000 to 7,000 m.

The continuous thermoplastic resin fiber used in this invention is composed of a thermoplastic resin composition. The thermoplastic resin composition contains a thermoplastic resin as the main ingredient (the thermoplastic resin typically accounts for 90% by mass or more of the composition), and other known additive(s) suitably added thereto.

The thermoplastic resin used here is widely selectable from those used for commingled yarn for composing composite material. The thermoplastic resin usable here is exemplified by polyolefin resins such as polyethylene, polypropylene and so forth; polyamide resin; polyester resins such as polyethylene terephthalate, polybutylene terephthalate and so forth; polyetherketone; polyethersulfone; thermoplastic polyetherimide; polycarbonate resin; and polyacetal resin. In this invention, the thermoplastic resin preferably contains polyamide resin. The polyamide resin usable in this invention will be described later.

The continuous thermoplastic resin fiber used in this invention is manufactured typically by using a continuous thermoplastic resin fiber bundle in which the continuous thermoplastic resin fibers are made up into a bundle, wherein a single continuous thermoplastic resin fiber bundle preferably has a total fineness of 40 to 600 dtex, more preferably 50 to 500 dtex, and even more preferably 100 to 400 dtex. Within these ranges, the continuous thermoplastic resin fibers will further be improved in the state of dispersion in the obtainable commingled yarn. The number of fibers composing the continuous thermoplastic resin fiber bundle is preferably 1 to 200 f, more preferably 5 to 100 f, even more preferably 10 to 80 f, and particularly 20 to 50 f. Within these ranges, the continuous thermoplastic resin fibers will further be improved in the state of dispersion in the obtainable commingled yarn.

In this invention, 1 to 100 bundles of the continuous thermoplastic resin fiber bundle are preferably used for manufacturing a single commingled yarn, 10 to 80 bundles are more preferably used, and 20 to 50 bundles are even more preferably used. Within these ranges, the effect of this invention will more effectively be demonstrated.

The total fineness of the continuous thermoplastic resin fiber used for manufacturing a single commingled yarn is preferably 200 to 12000 dtex, and more preferably 1000 to 10000 dtex. Within these ranges, the effect of this invention will more effectively be demonstrated.

The total number of fibers of the continuous thermoplastic resin fiber used for manufacturing a single commingled yarn is preferably 10 to 10000 f, more preferably 100 to 5000 f, and even more preferably 500 to 3000 f. Within these ranges, the commingled yarn will be improved in the commingling ability, and will be improved in the physical properties and texture as a composite material. With the number of fibers controlled to 10 f or more, the opened fibers will more easily be mixed in a uniform manner. Meanwhile, with the number of fibers controlled to 10000 f or less, domains where either fiber will unevenly be abundant are less likely to be formed, thereby a more uniform commingled yarn may be obtained.

The continuous thermoplastic resin fiber bundle used in this invention preferably has a tensile strength of 2 to 10 gf/d. Within this range, there will be a tendency that the commingled yarn is manufactured more easily.

<<Polyamide Resin Composition>>

The continuous thermoplastic resin fiber in this invention is more preferably composed of a polyamide resin composition.

The polyamide resin composition contains a polyamide resin as the main ingredient. The polyamide resin used here is exemplified by polyamide 4, polyamide 6, polyamide 11, polyamide 12, polyamide 46, polyamide 66, polyamide 610, polyamide 612, polyhexamethylene terephthalamide (polyamide 6T), polyhexamethylene isophthalamide (polyamide 6I), polymetaxylylene adipamide, polymetaxylylene dodecamide, polyamide 9T, and polyamide 9MT.

Among the polyamide resins described above, polyamide 6, polyamide 66, or xylylene diamine-based polyamide resin (XD-based polyamide) obtained by polycondensation of straight-chain, α, ω-aliphatic dibasic acid and xylylene diamine are more preferably used, from the viewpoints of formability and heat resistance. Among them, XD-based polyamide is more preferable from the viewpoints of heat resistance and fire retardancy. If the polyamide resin is a mixture, the XD-based polyamide preferably accounts for 50% by weight or more in the polyamide resin, and more preferably 80% by weight or more.

In this invention, the polyamide resin is particularly preferable if 50 mol % or more of the diamine structural unit thereof is derived from xylylene diamine, if the number-average molecular weight (Mn) thereof is 6,000 to 30,000, and in particular, if the weight average molecular weight thereof is 1,000 or smaller. Preferable modes of embodiment of the polyamide resin composition used in this invention will be explained below, of course, without limiting this invention.

The polyamide resin used in this invention preferably contains the diamine structural unit (structural unit derived from diamine), 50 mol % or more of which is derived from xylylene diamine, and is given in the form of fiber. In other words, this is a xylylene diamine-based polyamide resin polycondensed with a dicarboxylic acid, in which 50 mol % or more of the diamine is derived from xylylene diamine.

It is preferably a xylylene diamine-based polyamide resin in which preferably 70 mol % or more, and more preferably 80 mol % or more, of the diamine structural unit is derived from metaxylylene diamine and/or paraxylylene diamine; and in which preferably 50 mol % or more, more preferably 70 mol % or more, and particularly 80 mol % or more of the dicarboxylic acid structural unit (structural unit derived from dicarboxylic acid) is preferably derived from straight-chain, α, ω-aliphatic dicarboxylic acid preferably having 4 to 20 carbon atoms.

In particular in this invention, a preferable polyamide resin is such that 70 mol % or more of the diamine structural unit is derived from metaxylylene diamine, and 50 mol % or more of the dicarboxylic acid structural unit is derived from straight-chain aliphatic dicarboxylic acid having 4 to 20 carbon atoms; and a more preferable polyamide resin is such that 70 mol % or more of the diamine structural unit is derived from metaxylylene diamine, and 50 mol % or more of the dicarboxylic acid structural unit is derived from sebacic acid.

Diamines other than metaxylylene diamine and paraxylylene diamine, usable here as the source diamine component of the xylylene diamine-based polyamide resin are exemplified by aliphatic diamines such as tetramethylenediamine, pentamethylenediamine, 2-methylpentanediamine, hexamethylenediamine, heptamethylenediamine, octamethylenediamine, nonamethylenediamine, decamethylenediamine, dodecamethylenediamine, 2, 2, 4-trimethyl-hexamethylenediamine, and 2,4,4-trimethylhexamethylenediamine; alicyclic diamines such as 1,3-bis (aminomethyl) cyclohexane, 1,4-bis (aminomethyl) cyclohexane, 1,3-diaminocyclohexane, 1,4-diaminocyclohexane, bis (4-aminocyclohexyl) methane, 2,2-bis (4-aminocyclohexyl) propane, bis (aminomethyl) decalin, and bis (aminomethyl) tricyclodecane; and diamines having aromatic ring (s) such as bis (4-aminophenyl) ether, paraphenylenediamine, and bis(aminomethyl) naphthalene, all of which are usable independently, or two or more species may be used in combination.

When some diamine other than xylylene diamine is used as the diamine component, the content thereof is 50 mol % or less of the diamine structural unit, preferably 30 mol % or less, more preferably 1 to 25 mol %, and even more preferably 5 to 20 mol %.

The straight-chain, α, ω-aliphatic dicarboxylic acid having 4 to 20 carbon atoms, suitably used as the source dicarboxylic acid component of the polyamide resin, is exemplified by aliphatic dicarboxylic acids such as succinic acid, glutaric acid, pimellic acid, suberic acid, azelaic acid, adipic acid, sebacic acid, undecanedioic acid, and dodecanedioic acid, all of which are usable independently, or two or more species may be used in combination. Among them, adipic acid or sebacic acid is preferable, and sebacic acid is particularly preferable, from the viewpoint that the polyamide resin will have the melting point fallen in a range suitable for molding.

The dicarboxylic acid component other than the straight-chain, α, ω-aliphatic dicarboxylic acid having 4 to 20 carbon atoms is exemplified by phthalic acid compounds such as isophthalic acid, terephthalic acid, and orthophthalic acid; and naphthalenedicarboxylic acids in the form of isomers such as 1,2-naphthalenedicarboxylic acid, 1,3-naphthalenedicarboxylic acid, 1,4-naphthalenedicarboxylic acid, 1,5-naphthalenedicarboxylic acid, 1,6-naphthalenedicarboxylic acid, 1,7-naphthalenedicarboxylic acid, 1,8-naphthalenedicarboxylic acid, 2, 3-naphthalenedicarboxylic acid, 2,6-naphthalenedicarboxylic acid, and 2,7-naphthalenedicarboxylic acid, all of which are usable independently, or two or more species may be used in combination.

The dicarboxylic acid other than the straight-chain, α, ω-aliphatic dicarboxylic acid having 4 to 20 carbon atoms, when used as the dicarboxylic acid component, is preferably terephthalic acid or isophthalic acid, taking formability and barrier performance into account. Ratio of content of terephthalic acid or isophthalic acid is preferably 30 mol % or less relative to the dicarboxylic acid structural unit, more preferably 1 to 30 mol %, and particularly 5 to 20 mol %.

In addition, as a copolymerizable component composing the polyamide resin other than the diamine component and dicarboxylic acid component, also lactams such as s-caprolactam and laurolactam; and aliphatic aminocarboxylic acids such as aminocaproic acid and aminoundecanoic acid may be used, without degrading the effects of this invention.

Preferable examples of the polyamide resin include polymetaxylylene adipamide resin, polymetaxylylene sebacamide resin, polyparaxylylene sebacamide resin, and, mixed polymetaxylylene/paraxylylene adipamide resin obtained by polycondensing a mixed xylylene diamine which contains metaxylylene diamine and paraxylylene diamine, with adipic acid. More preferable examples include polymetaxylylene sebacamide resin, polyparaxylylene sebacamide resin, and, mixed polymetaxylylene/paraxylylene sebacamide resin obtained by polycondensing a mixed xylylene diamine which contains metaxylylene diamine and paraxylylene diamine, with sebacic acid. With these polyamide resins, the formability tends to improve distinctively.

The polyamide resin used in this invention preferably has a number-average molecular weight (Mn) of 6,000 to 30,000, wherein 0.5 to 5% by mass of which is preferably a polyamide resin having a weight-average molecular weight of 1,000 or smaller.

With the number-average molecular weight (Mn) controlled within the range from 6,000 to 30,000, an obtainable composite material or a molded article thereof tends to be improved in the strength. The number-average molecular weight (Mn) is more preferably 8,000 to 28,000, even more preferably 9,000 to 26,000, yet more preferably 10,000 to 24,000, particularly 11,000 to 22,000, and most preferably 12,000 to 20,000. Within these ranges, the heat resistance, elastic modulus, dimensional stability, and formability may further be improved.

The number-average molecular weight (Mn) in this context is calculated using the equation below, using terminal amino group concentration $[NH_2]$ (microequivalent/g) and terminal carboxy group concentration [COOH] (microequivalent/g) of the polyamide resin.

$$\text{Number-average molecular weight(Mn)} = 2{,}000{,}000/([COOH]+[NH_2])$$

The polyamide resin preferably contains 0.5 to 5% by mass of a component having a weight-average molecular weight (Mw) of 1,000 or smaller. With such content of the low molecular weight component, the obtainable polyamide resin will be improved in the impregnating ability into the continuous reinforcing fiber, and thereby the resultant molded article will be improved in the strength and the warping resistance. With the content exceeding 5% by mass, the low molecular weight component may bleed to degrade the strength, and to degrade the appearance of the surface.

The content of the component having a weight-average molecular weight of 1,000 or smaller is preferably 0.6 to 5% by mass.

The content of the low molecular weight component having a weight-average molecular weight of 1,000 or smaller may be controlled by adjusting melt polymerization conditions such as the temperature or pressure in the process of polymerization of the polyamide resin, or the dropping rate of diamine. In particular, the content is controllable to an arbitrary ratio, by reducing the pressure in the reactor vessel in the late stage of melt polymerization to thereby remove the low molecular weight component. Alternatively, the low molecular weight component may be removed by hot water extraction of the polyamide resin manufactured by the melt polymerization, or by allowing solid phase polymerization to proceed under reduced pressure after the melt polymerization. In the solid phase polymerization, the content of the low molecular weight component is controlled to an arbitrary value, by controlling the temperature or the degree of reduction in pressure. Alternatively, the content is controllable by later adding the low molecular weight component having a weight-average molecular weight of 1,000 or smaller to the polyamide resin.

The content of the component having a weight-average molecular weight of 1,000 or smaller may be measured by gel permeation chromatography (GPC) using "HLC-8320GPC" from TOSOH Corporation, and may be determined based on standard polymethyl methacrylate (PMMA) equivalent value. The measurement may be conducted by using two "TSK gel Super HM-H" columns, with hexafluoroisopropanol (HFIP) containing 10 mmol/1 of sodium trifluoroacetate used as a solvent, at a resin concentration of 0.02% by mass, a column temperature of 40° C., a flow rate of 0.3 ml/min, and with a refractive index detector (RI). A standard curve is obtained by measuring solutions of PMMA prepared by dissolving it at six levels of concentration into HFIP.

The polyamide resin used in this invention preferably has a molecular weight distribution (weight-average molecular weight/number-average molecular weight (Mw/Mn)) of 1.8 to 3.1. The molecular weight distribution is more preferably 1.9 to 3.0, and even more preferably 2.0 to 2.9. With the molecular weight distribution controlled within these ranges, there will be a tendency that the composite material featured by good mechanical characteristics is obtained more easily.

The molecular weight distribution of the polyamide resin is controllable, typically by suitably selecting species and amount of initiator or catalyst used in the polymerization, or conditions of polymerization reaction such as reaction temperature, pressure, time and so forth. It may also be modified by mixing two or more species of polyamide resins having different average molecular weights obtained under different polymerization conditions, or by subjecting the polyamide resin after polymerization to fractional precipitation.

The molecular weight distribution may be determined by gel permeation chromatography (GPC), typically by using an apparatus "HLC-8320GPC" from TOSOH Corporation, equipped with two "TSK gel Super HM-H" columns, with hexafluoroisopropanol (HFIP) containing 10 mmol/1 of sodium trifluoroacetate used as an eluent, at a resin concentration of 0.02% by mass, a column temperature of 40° C., a flow rate of 0.3 ml/min, and with a refractive index detector (RI), yielding results as standard polymethyl methacrylate equivalent values. A standard curve is obtained by measuring solutions of PMMA prepared by dissolving it at six levels of concentration into HFIP.

The polyamide resin preferably has a melt viscosity of 50 to 1200 Pa·s, when measured at a temperature 30° C. higher than the melting point of polyamide resin (Tm), a shear velocity of 122 $sec^{-1}$, and a moisture content of polyamide resin of 0.06% by mass or less. With the melt viscosity controlled within this range, the polyamide resin will be more easily processed into film or fiber. For the case where the polyamide resin has two or more melting points as described later, the measurement is conducted assuming the temperature corresponded to the top of an endothermic peak in the higher temperature side, as the melting point.

The melt viscosity more preferably falls in the range from 60 to 500 Pa·s, and even more preferably in the range from 70 to 100 Pa·s.

The melt viscosity of the polyamide resin may be controlled by suitably selecting, for example, ratio of loading of the source dicarboxylic acid component and the diamine component, polymerization catalyst, molecular weight modifier, polymerization temperature, and polymerization time.

The polyamide resin, after absorbing water, preferably has a retention of flexural modulus of 85% or larger. With the retention of flexural modulus controlled in this range, when moistened with water, the molded article will be less likely to degrade the physical properties under high temperature and high humidity, and will be less likely to cause shape changes such as warpage.

Now the retention of flexural modulus after water absorption is defined by ratio (%) of the flexural modulus of a bending test piece composed of polyamide resin after moistened with 0.5% by mass of water, relative to the flexural modulus after moistened with 0.1% by mass of water, wherein a large value of retention means that the flexural modulus is less likely to decrease.

The retention of flexural modulus after water absorption is preferably 90% or larger, and more preferably 95% or larger.

The retention of flexural modulus of the polyamide resin after absorbing water may be controlled typically based on the ratio of mixing of paraxylylene diamine and metaxylylene diamine, wherein the larger the ratio of paraxylylene diamine, the better the retention of flexural modulus. It is alternatively tuned by controlling the degree of crystallization of a bending test piece.

The percentage of water absorption of the polyamide resin, measured by immersing it into water at 23° C. for a week, and immediately after taking it out and wiped, is preferably 1% by mass or smaller, more preferably 0.6% by mass or smaller, and even more preferably 0.4% by mass or smaller. Within these ranges, the molded article will more easily be prevented from deforming due to water absorption, and the composite material is suppressed from foaming in the process of molding under heating and pressure, to thereby produce a molded article only with a small amount of bubbles.

The polyamide resin preferably has a terminal amino group concentration ($[NH_2]$) of smaller than 100 microequivalents/g, more preferably 5 to 75 microequivalents/g, and even more preferably 10 to 60 microequivalents/g; and, preferably has a terminal carboxy group concentration ([COOH]) of smaller than 150 microequivalents/g, more preferably 10 to 120 microequivalents/g, and even more preferably 10 to 100 microequivalents/g. With the terminal group concentrations controlled in these ranges, the polyamide resin will be stabilized in viscosity when molded into film or fiber, and will be more likely to react with a carbodiimide compound described later.

The ratio of terminal amino group concentration to the terminal carboxy group concentration ($[NH_2]$/[COOH]) is preferably 0.7 or smaller, more preferably 0.6 or smaller, and even more preferably 0.5 or smaller. With the ratio larger than 0.7, it may become difficult to control the molecular weight when the polyamide resin is polymerized.

The terminal amino group concentration may be measured by dissolving 0.5 g of polyamide resin into 30 ml of phenol/methanol (4:1) mixed solvent at 20 to 30° C. under stirring, and by titrating the solution with 0.01 N hydrochloric acid. Meanwhile, the terminal carboxy group concentration may be determined by dissolving 0.1 g of polyamide resin into 30 ml of benzyl alcohol at 200° C., adding 0.1 ml of phenol red solution at 160° C. to 165° C., and by titrating the solution with a titrant prepared by dissolving 0.132 g of KOH into 200 ml of benzyl alcohol (0.01 mol KOH/1), assuming the point of time when the color turns from yellow to red and remains in red as the end point.

The polyamide resin in this invention is preferably characterized by a molar ratio of the reacted diamine unit, relative to the reacted dicarboxylic acid (number of moles of reacted diamine unit/number of moles of reacted dicarboxylic acid, occasionally referred to as "reaction molar ratio", hereinafter), of 0.97 to 1.02. Within this range, it becomes easier to control the molecular weight or molecular weight distribution of the polyamide resin in an arbitrary range.

The reaction molar ratio is more preferably smaller than 1.0, even more preferably smaller than 0.995, and particularly smaller than 0.990; meanwhile the lower limit is more preferably 0.975 or larger, and even more preferably 0.98 or larger.

The reaction molar ration (r) is determined using the equation below:

$$r=(1-cN-b(C-N))/(1-cC+a(C-N))$$

where, a: M1/2 b: M2/2 c: 18.015 (molecular weight of water (g/mol))

M1: molecular weight of diamine (g/mol)

M2: molecular weight of dicarboxylic acid (g/mol)

N: terminal amino group concentration (equivalent/g)

C: terminal carboxy group concentration (equivalent/g)

For the case where the polyamide resin is synthesized from the diamine component and the dicarboxylic acid component, each composed of monomers having different molecular weights, M1 and M2 are of course calculated according to the ratios of blending of the monomers to be blended as the source materials. While the molar ratio of the fed monomers and the reaction molar ratio will agree if the reactor vessel is a perfectly closed system, the actual reactor device will never be a perfectly closed system, so that the feed molar ratio and the reaction molar ratio do not always agree. Since also the fed monomers do not always react completely, so that the feed molar ratio and the reaction molar ration again do not always agree. Accordingly, the reaction molar ratio means the molar ratio of the monomer actually reacted, which is determined based on the terminal group concentration of the resultant polyamide resin.

The reaction molar ratio of the polyamide resin may be controlled by setting suitable values for the reaction conditions which include the feed molar ratio of the source dicarboxylic acid component and the diamine component, the reaction time, the reaction temperature, the dropping rate of xylylene diamine, the pressure in the reactor, and the time when the pressure starts to decline.

For the case where the polyamide resin is manufactured by a so-called salt process, the reaction molar ratio may be set to 0.97 to 1.02, typically by setting the ratio of source diamine component/source dicarboxylic acid component to this range, and by allowing the reaction to proceed thoroughly. Meanwhile for the case where the method involves continuous dropping of diamine into the molten dicarboxylic acid, this is enabled by setting the feed molar ratio to this range, and additionally by controlling the amount of diamine to be refluxed in the process of dropping of diamine, and by removing the dropped diamine from the reaction system. The diamine may be removed from the reaction system, specifically by controlling the temperature of a reflux tower to an optimum range, or by optimizing the geometry and the amount of filling of packed matters in the packed column, such as Raschig Ring, Lessing Ring and saddle. Alternatively, unreacted diamine may be removed from the system, by shortening the reaction time after the diamine was dropped. Alternatively, unreacted diamine may optionally be eliminated from the reaction system by controlling the dropping rate of diamine. By these methods, the reaction molar ratio may be controlled within a predetermined range even if the feed ratio should deviate from the target range.

The polyamide resin may be manufactured by any known method under known polymerization conditions, without special limitation. A small amount of monoamine or monocarboxylic acid may be added as a molecular weight modifier, in the process of polycondensation of the polyamide resin. For example, the polyamide resin may be manufactured by heating a salt, which is composed of the diamine component containing xylylene diamine and a dicarboxylic acid such as adipic acid or sebacic acid, in the presence of water under pressure, and allowing the salt to polymerize in a molten state while removing the added water and released water. Alternatively, the polyamide resin may be manufactured by directly adding xylylene diamine to a molten dicarboxylic acid, and by allowing the polycondensation to proceed under normal pressure. In this case, for the purpose of keeping a uniform liquid state of the reaction system, the polycondensation is allowed to proceed by adding diamine continuously to dicarboxylic acid, while heating the reaction system so that the reaction temperature will not fall under the melting points of oligoamide and polyamide being produced.

The polyamide resin, after manufactured by the melt polymerization process, may further be subjected to solid phase polymerization. The solid phase polymerization may be allowed to proceed by any known method and under any known polymerization conditions without special limitation.

In this invention, the melting point of the polyamide resin is preferably 150 to 310° C., and more preferably 180 to 300° C.

The glass transition point of the polyamide resin is preferably 50 to 100° C., more preferably 55 to 100° C., and particularly 60 to 100° C. Within these ranges, the heat resistance tends to be improved.

Now, the melting point is the temperature corresponded to the top of an endothermic peak observed in the process of temperature elevation in DSC (differential scanning calorimetry). The glass transition temperature is defined by a glass transition temperature observed when a sample is once melted under heating so as to eliminate any influence of thermal history on the crystallinity, and then heated again. For the measurement, "DSC-60" from Shimadzu Corporation was used, with approximately 5 mg of the sample, and at a flow rate of nitrogen used as an atmospheric gas of 30 ml/min. The melting point may be determined based on the temperature corresponded to the top of an endothermic peak, observed when the sample is heated at a heating rate of 10° C./min, from room temperature up to a level not lower than the expected melting point. The glass transition point may be determined by rapidly cooling the molten polyamide resin with dry ice, and then heating again up to a temperature not lower than the melting point, at a heating rate of 10° C./min.

The polyamide resin composition used in this invention may contain other polyamide resin or elastomer component, besides the above-described xylylene diamine-based polyamide resin. Such other polyamide resin is exemplified by polyamide 66, polyamide 6, polyamide 46, polyamide 6/66, polyamide 10, polyamide 612, polyamide 11, polyamide 12, hexamethylenediamine, polyamide 66/6T composed of adipic acid and terephthalic acid, hexamethylenediamine, and polyamide 6I/6T composed of isophthalic acid and terephthalic acid. The amount of mixing thereof is preferably 5% by mass or less relative to the polyamide resin composition, and is more preferably 1% by mass or less.

The elastomer component usable here is exemplified by known elastomers such as polyolefin-based elastomer, diene-based elastomer, polystyrene-based elastomer, polyamide-based elastomer, polyester-based elastomer, polyurethane-based elastomer, fluorine-containing elastomer, and silicone-based elastomer. Among them, polyolefin-based elastomer and polystyrene-based elastomer are preferable. As the elastomer, it is also preferable to use modified elastomer which is modified by an α, β-unsaturated carboxylic acid, acid anhydride thereof, or acrylamide and derivatives of these compounds, in the presence or absence of a radical initiator, for the purpose of making the elastomer compatible with the polyamide resin.

The contents of such other polyamide resin and the elastomer component is typically 30% by mass or less in the polyamide resin composition, preferably 20% by mass or less, and particularly 10% by mass or less.

Only a single species of the polyamide resin compositions described above may be used, or two or more species thereof may be used in a mixed manner.

In addition, the polyamide resin composition used in this invention may be blended with a single species of, or two or more species of resins such as polyester resin, polyolefin resin, polyphenylene sulfide resin, polycarbonate resin, polyphenylene ether resin, and polystyrene resin, without departing from the purpose and effects of this invention. The amount of mixing of these compounds is preferably 10% by mass or less relative to the polyamide resin composition, and more preferably 1% by mass or less.

In addition, the thermoplastic resin composition used in this invention may be blended with additive(s) including stabilizers such as antioxidant and heat stabilizer, hydrolysis resistance modifier, weather resistant stabilizer, matting agent, UV absorber, nucleating agent, plasticizer, dispersion aid, flame retarder, antistatic agent, anti-coloring agent, anti-gelling agent, colorant, and mold releasing agent, without departing from the purpose and effects of this invention. Details of these additives may be referred to the description in paragraphs [0130] to [0155] of Japanese Patent No. 4894982, the contents of which are incorporated into this specification.

While the thermoplastic resin fiber in this invention may be used with the surface treatment agents, the fiber may substantially dispense with them. "Substantially dispense with" means that the total amount of the additives is 0.01% by mass or less relative to the thermoplastic resin fiber.

<Continuous Reinforcing Fiber>

The commingled yarn of this invention contains the continuous reinforcing fiber. The continuous reinforcing fiber means the one having a length longer than 6 mm. The average fiber length of the continuous reinforcing fiber used in this invention is preferably, but not specifically limited to, 1 to 20,000 m from the viewpoint of formability, more preferably 100 to 10,000 m, and even more preferably 1,000 to 7,000 m.

The continuous reinforcing fiber used in this invention preferably has a total fineness per a single commingled yarn of 100 to 50000 dtex, more preferably 500 to 40000 dtex, even more preferably 1000 to 10000 dtex, and particularly 1000 to 3000 dtex. Within these ranges, the resultant commingled yarn will be processed more easily, and will be improved in the elastic modulus and strength.

The continuous reinforcing fiber used in this invention preferably has a total number of fibers per a single commingled yarn of 500 to 50000 f, more preferably 500 to 20000 f, even more preferably 1000 to 10000 f, and particularly 1500 to 5000 f. Within these ranges, the continuous reinforcing fiber will disperse in the commingled yarn in an improved manner.

A single commingled yarn may be manufactured by using a single continuous reinforcing fiber bundle, or a plurality of continuous reinforcing fiber bundles, so as to satisfy the total fineness and the total number of fibers of the continuous reinforcing fiber. In this invention, it is preferable to use 1 to 10 continuous reinforcing fiber bundles for the manufacture, more preferable to use 1 to 3 continuous reinforcing fiber bundles, and even more preferable to use a single continuous reinforcing fiber bundle.

The continuous reinforcing fiber contained in the commingled yarn of this invention preferably has an average tensile modulus of 50 to 1000 GPa, and more preferably 200 to 700 GPa. Within these ranges, the commingled yarn as a whole will have an improved tensile modulus.

The continuous reinforcing fiber is exemplified by carbon fiber; glass fiber; plant fiber (including kenaf and bamboo fibers, etc.); inorganic fibers such as alumina fiber, boron fiber, ceramic fiber and metal fiber (steel fiber, etc.); and organic fibers such as aramid fiber, polyoxymethylene fiber, aromatic polyamide fiber, polyparaphenylene benzobisoxazole fiber, and ultrahigh molecular weight polyethylene fiber. The inorganic fibers are more preferable, and among them, carbon fiber and/or glass fiber are preferably used by virtue of their high strength and high elastic modulus despite of their lightness in weight. Carbon fiber is more preferable. The carbon fiber suitably used is exemplified by polyacrylonitrile-based carbon fiber, and pitch-based carbon fiber. Also plant-originated carbon fiber, such as lignin and cellulose, may be used. By using the carbon fiber, the obtainable molded article tends to have an improved mechanical strength.

<<Surface Treatment Agent, Etc. For Continuous Reinforcing Fiber>>

The commingled yarn of this invention contains the surface treatment agent and/or sizing agent, and preferably contains surface treatment agent and/or sizing agent for the continuous reinforcing fiber.

As the surface treatment agent and/or sizing agent for the continuous reinforcing fiber used in this invention, those described in paragraphs [0093] and [0094] of Japanese Patent No. 4894982 are suitably employed, the contents of which are incorporated into this specification.

In particular for the case where a thermoplastic resin having a polar group is used in this invention, the continuous reinforcing fiber is preferably treated with the surface treatment agent, etc. having a functional group reactive with the polar group of the thermoplastic resin. The functional group reactive with the polar group of the thermoplastic resin typically forms a chemical bond with the thermoplastic resin, typically in the process of molding under heating. The treatment agent for the continuous reinforcing fiber, having the functional group reactive with the polar group of the thermoplastic resin, preferably has a function of sizing the continuous reinforcing fiber, meaning that a function of assisting physical sizing of the individual fibers in the commingled yarn before being processed under heating.

More specifically, the surface treatment agent, etc. used in this invention is preferably at least one species selected from epoxy resin, urethane resin, silane coupling agent, water-insoluble nylon and water-soluble nylon, more preferably at least one species selected from epoxy resin, urethane resin, water-insoluble nylon and water-soluble nylon, and even more preferably water-soluble nylon.

The epoxy resin is exemplified by glycidyl compounds such as epoxy alkane, alkane diepoxide, bisphenol A glycidyl ether, dimer of bisphenol A glycidyl ether, trimer of bisphenol A glycidyl ether, oligomer of bisphenol A glycidyl ether, polymer of bisphenol A glycidyl ether, bisphenol F glycidyl ether, dimer of bisphenol F glycidyl ether, trimer of bisphenol F glycidyl ether, oligomer of bisphenol F glycidyl ether, polymer of bisphenol F glycidyl ether, stearyl glycidyl ether, phenyl glycidyl ether, ethylene oxide lauryl alcohol glycidyl ether, ethylene glycol diglycidyl ether, polyethylene glycol diglycidyl ether, and propylene glycol diglycidyl ether; glycidyl ester compounds such as glycidyl benzoate, glycidyl p-toluate, glycidyl stearate, glycidyl laurate, glycidyl palmitate, glycidyl oleate, glycidyl linoleate, glycidyl linolenate, and diglycidyl phthalate; and glycidylamine compounds such as tetraglycidylaminodiphenylmethane, triglycidylaminophenol, diglycidylaniline, diglycidyltoluidine, tetraglycidylmetaxylenediamine, triglycidyl cyanurate, and triglycidyl isocyanurate.

As the urethane resin, usable here are those obtained, for example, by reacting polyol, or polyol yielded by transesterification between oil or fat and polyhydric alcohol, with polyisocyanate.

The polyisocyanate is exemplified by aliphatic isocyanates such as 1,4-tetramethylene diisocyanate, 1,6-hexamethylene diisocyanate, 2,2,4-trimethylhexamethylene diisocyanate, and 2,8-diisocyanatomethyl caproate; alicyclic diisocyanates such as 3-isocyanatomethyl-3,5,5-trimethylcyclohexyl isocyanate, and methylcyclohexyl-2,4-diisocyanate; aromatic diisocyanates such as toluylene diisocyanate, diphenylmethane diisocyanate, 1,5-naphthene diisocyanate, diphenylmethylmethane diisocyanate, tetraalkyldiphenylmethane diisocyanate, 4,4-dibenzyl diisocyanate, and 1,3-phenylene diisocyanate; chlorinated diisocyanates; and brominated diisocyanates. These compounds may be used independently, or as a mixture of two or more species thereof.

The polyol is exemplified by various polyols typically used for manufacturing urethane resins, which include ethylene glycol, butanediol, hexanediol, neopentyl glycol, bisphenol A, cyclohexanedimethanol, trimethylolpropane, glycerin, pentaerythritol, polyethylene glycol, polypropylene glycol, polyester polyol, polycaprolactone, polytetramethylene ether glycol, polythioether polyol, polyacetal polyol, polybutadiene polyol, and furan dimethanol. These compounds may be used independently, or as a mixture of two or more species thereof.

The silane coupling agent is exemplified by trialkoxy or triaryloxysilane compounds such as aminoporopyl triethoxysilane, phenylaminopropyl trimethoxysilane, glycidylpropyl triethoxysilane, metacryloxypropyl trimethoxysilane, and vinyl triethoxysilane; ureidosilane; sulfide silane; vinylsilane; and imidazole silane.

Now, the water-insoluble nylon means that 99% by weight or more of nylon, when 1 g thereof is added to 100 g of water at 25° C., remains unsolubilized.

When the water-insoluble nylon is used, it is preferable to disperse or suspend a powdery water-insoluble nylon into water or organic solvent. The blended fiber bundle may be immersed into such dispersion or suspension of the powdery water-insoluble nylon, and then dried, thereby given in the form of commingled yarn.

The water-insoluble nylon is exemplified by nylon 6, nylon 66, nylon 610, nylon 11, nylon 12, xylylene diamine-based polyamide resin (preferably polyxylylene adipamide, polyxylylene sebacamide) and emulsified dispersions of powders of these copolymers obtained by adding thereto a nonionic, cationic or anionic surfactant, or any mixture of these surfactants. The water-insoluble nylon is commercialized typically in the form of water-insoluble nylon emulsion, typically available as Sepolsion PA from Sumitomo Seika Chemicals Co., Ltd, and Michem Emulsion from Michelman Inc.

Now the water-soluble nylon is characterized in that, when one gram thereof is added to 100 g of water at 25° C., 99% by mass or more thereof dissolves into water.

The water-soluble nylon is exemplified by modified polyamides such as N-methoxymethylated nylon grafted with acrylic acid, and amido group-introduced N-methoxymethylated nylon. The water-soluble nylon is exemplified by commercialized products such as "AQ-nylon" from Toray Industries, Inc., and "Toresin" from Nagase ChemteX Corporation.

The surface treatment agent may be used independently, or two or more species may be used in combination.

In this invention, the dispersibility of the continuous reinforcing fiber in the commingled yarn may be improved, by treating the continuous thermoplastic resin fiber and the continuous reinforcing fiber with a somewhat smaller amount of surface treatment agent, etc., to make them into the blended fiber bundle.

<<Method of Treating the Continuous Reinforcing Fiber with Surface Treatment Agent, Etc.>>

The method of treating the continuous reinforcing fiber with the surface treatment agent, etc. may follow any known method. An exemplary method is such as dipping the continuous reinforcing fiber into a liquid which contains the surface treatment agent, etc. (aqueous solution, for example), to thereby allow the surface treatment agent, etc. to adhere onto the surface of the continuous reinforcing fiber. Alternatively, the surface treatment agent, etc. may be blown by air onto the surface of the continuous reinforcing fiber. Alternatively, a commercially available continuous reinforcing fiber, having been treated with the surface treatment agent, etc., may be used, or a commercially available product, having the surface treatment agent, etc. once washed off, may be re-treated by a desired amount of agent.

<Re-Addition of Surface Treatment Agent, Etc.>

In this invention, the blended fiber bundle having been produced as descried above is further processed with the surface treatment agent and/or sizing agent. With such treatment, the fiber may be sized while keeping high levels of dispersion of the continuous thermoplastic resin fiber and continuous reinforcing fiber in the commingled yarn, and thereby the commingled yarn having only a small amount of voids may be obtained.

The surface treatment agent, etc., which is applied after the blended fiber bundle was formed, is suitably selectable from the surface treatment agent, etc. for the continuous reinforcing fiber described above, and is preferably at least one species selected from epoxy resin, urethane resin, silane coupling agent and water-soluble nylon. Only a single species of the surface treatment agent, etc. may be used independently, or two or more species may be used in combination.

In this invention, the surface treatment agent, etc. used for treating the continuous reinforcing fiber, and the surface treatment agent, etc. used for treating the blended fiber bundle, may be same of different. In this invention, the main ingredient of the surface treatment agent, etc. used for the continuous reinforcing fiber is preferably different from the main ingredient of the surface treatment agent, etc. used for treating the blended fiber bundle. In other words, one preferable embodiment of the commingled yarn of this invention is exemplified by a case where at least two species of the surface treatment agent and/or sizing agent are contained.

With such configuration, the amount of fall of the fiber from the commingled yarn may be suppressed effectively.

The total amount of the surface treatment agent, etc. in the blended fiber bundle is preferably 0.1 to 1.5% by weight relative to the blended fiber bundle, and is more preferably 0.3 to 0.6% by weight.

Meanwhile, the total amount of the surface treatment agent, etc. in the commingled yarn is preferably 2.0% by weight or more relative to the commingled yarn, preferably 2.0 to 12.0% by weight, more preferably 4.0 to 10.0% by weight, and even more preferably 4.0 to 6.0% by weight. With the total amount of the surface treatment agent, etc. in the commingled yarn controlled to 12.0% by weight or below, the obtainable commingled yarn tends to be improved in the workability.

It is general that the blended fiber bundle, when dried after applied with the surface treatment agent, further sizes, so that also the surface treatment agent, etc. for the blended fiber bundle impregnates thereinto to some degree. Accordingly, the ratio by weight of the total amount of the surface treatment agent, etc. for the blended fiber bundle and the total amount of the surface treatment agent, etc. added thereafter is preferably (0.1 to 1.5): (2.0 to 12), and is more preferably (0.3 to 0.6): (4.0 to 10).

In addition, the commingled yarn of this invention may contain additional component(s) other than the continuous thermoplastic resin fiber, the continuous reinforcing fiber, and the surface treatment agent and/or sizing agent described above, which are exemplified by short carbon fiber, carbon nanotube, fullerene, micro cellulose fiber, talc and mica. The amount of addition of these additional components is preferably 5% by mass or less relative to the commingled yarn.

<Method for Manufacturing Commingled Yarn>

Next, the method for manufacturing a commingled yarn of this invention will be described. The method for manufacturing a commingled yarn of this invention includes immersing a blended fiber bundle into a liquid which contains the surface treatment agent and/or sizing agent, followed by drying, wherein the blended fiber bundle includes the continuous thermoplastic resin fiber, the continuous reinforcing fiber, and the surface treatment agent and/or sizing agent, the total content of the surface treatment agent and/or sizing agent is 0.1 to 1.5% by weight relative to the total amount of the continuous thermoplastic resin fiber and the continuous reinforcing fiber.

In this invention, the blended fiber bundle, having a total content of the surface treatment agent, etc. of 0.1 to 1.5% by weight, relative to the total content of the continuous thermoplastic resin fiber and the continuous reinforcing fiber, is used. By manufacturing the blended fiber bundle with thus somewhat smaller amount of the surface treatment agent, the dispersing property of the continuous reinforcing fiber in the commingled yarn may be improved. By further applying the surface treatment agent, etc. to the blended fiber bundle, having been improved in the dispersing property of the continuous reinforcing fiber, and then by drying it, the blended fiber bundle is sized, and thereby the commingled yarn only with a small amount of voids may be obtained while keeping a high level of dispersing property.

First, an exemplary method for manufacturing the blended fiber bundle in this invention will be described.

At first, wound articles of the continuous thermoplastic resin fiber bundle and the continuous reinforcing fiber bundle are prepared. The wound articles may be provided one by one for the continuous thermoplastic resin fiber bundle and the continuous reinforcing fiber bundle, or may be provided in a multiple manner. It is preferable to suitably control the ratio of numbers of fibers, and the ratio of fineness of the continuous thermoplastic resin fiber and the continuous reinforcing fiber, so that the target values are achieved therefor, when the fibers are made up into the blended fiber bundle. It is preferable to suitably control the ratio of number of fibers so as to achieve the target value when made up into the blended fiber bundle, also based on the number of wound articles.

The continuous thermoplastic resin fiber bundle and the continuous reinforcing fiber bundle are unwound from the wound articles, and are opened by any of known method. The opening is effected by allowing the bundles to pass through a plurality of guides, applying stress, or blowing air. While opening the continuous thermoplastic resin fiber bundle and the continuous reinforcing fiber bundle, the continuous thermoplastic resin fiber bundle and the continuous reinforcing fiber bundle are combined to forma single bundle. The bundle is further uniformized through guiding, stress application or air blow, to yield a blended fiber bundle, and then taken up into a wound article using a winder.

Next, a method for manufacturing the commingled yarn from the blended fiber bundle will be explained.

FIG. 1 illustrates an exemplary method for manufacturing a commingled yarn of this invention, wherein the blended fiber bundle is unwound from a roll 1 having the blended fiber bundle wound thereon, dipped into a liquid 2 which contains the surface treatment agent and/or sizing agent, dried in a drying zone 3, and then taken up onto a roll 4. A wringing step 5 may additionally be provided after the dipping and before the drying.

The wringing step may be implemented typically by allowing the blended fiber bundle to pass between rolls. By providing the wringing step, the liquid 2 which contains the surface treatment agent, etc. may be impregnated more deeply inside the blended fiber bundle, and thereby the commingled yarn with a smaller content of voids may be obtained.

While the drying may be implemented by any known method, finer tuning of the drying conditions enables more effective sizing of the blended fiber bundle.

A first embodiment of drying is exemplified by a mode where the blended fiber bundle is dried at a temperature lower than the glass transition temperature (Tg) of the thermoplastic resin which composes the continuous thermoplastic resin fiber. By dried at a temperature lower than the glass transition temperature, the blended fiber bundle is effectively suppressed from bending, due to heat-induced warpage of the continuous thermoplastic resin fiber.

The heating is conducted in a temperature range of (Tg−3° C.) or lower, more preferably in the range from (Tg−50° C.) to (Tg−3° C.), more preferably in the range from (Tg−25° C.) to (Tg−3° C.) and specifically in the range from 30 to 60° C.

The drying time in this case is preferably 40 to 120 minutes, more preferably 45 to 70 minutes, and even more preferably 50 to 60 minutes.

A second embodiment of drying is exemplified by a mode where the drying of the blended fiber bundle is preceded by a step of annealing the thermoplastic resin fiber to be used as a source material of the blended fiber bundle. It is preferable to manufacture the blended fiber bundle, after the thermoplastic resin fiber in itself is independently annealed. By such annealing before the drying, the thermoplastic resin fiber may be dried after being shrunk to some degree, so that a good commingled yarn may be obtainable without bending the blended fiber bundle, even by drying at high temperatures for a short time. The annealing of the thermoplastic resin fiber may be implemented typically at a process temperature of (Tg+20° C.) to (Tm−20° C.), under a tensile load of 0 to 2 gf, for 0.4 to 60 seconds, followed by cooling under a tensile load of 0 to 25 gf for 1.2 to 2.0 seconds, and then continuously implementing these steps at a process speed of 300 m/min or below.

The drying temperature of the blended fiber bundle, dipped into the liquid which contains the surface treatment agent and/or sizing agent, is preferably 40° C. or above at the lowest, more preferably 60° C. or above, even more preferably 80° C. or above, meanwhile preferably 150° C. or below, more preferably 120° C. or below, and even more preferably 110° C. or below. The drying time is preferably 10 to 30 minutes, and more preferably 15 to 25 minutes.

As the surface treatment agent, etc. in the liquid which contains the surface treatment agent and/or sizing agent, those described regarding the surface treatment agent, etc. for re-addition described above may be used, defined by the same preferable ranges. The main ingredient of the surface treatment agent and/or sizing agent contained in the blended fiber bundle is preferably different from the main ingredient of the liquid which contains the surface treatment agent and/or sizing agent.

In this invention, the liquid which contains the surface treatment agent, etc. used for dipping is preferably an aqueous solution. Now, the aqueous solution means that water is the main ingredient of the solvent component, and preferably that water accounts for 90% by weight or more of the solvent component, and particularly that the solvent component is substantially composed of water only. By using water as the solvent, the surface treatment agent and the blended fiber bundle become more compatible, and this makes the process stable.

The amount of the surface treatment agent and/or sizing agent (% by weight), in the liquid which contains the surface treatment agent and/or sizing agent, is preferably 0.1 to 5% by weight, and more preferably 1 to 5% by weight.

The dipping time is preferably 5 seconds to 1 minute.

<Formed Article of Commingled Yarn>

The commingled yarn of this invention may be used in the form of braid, weave fabric, knitted fabric or non-weave fabric, according to any known method.

The braid is exemplified by square braid, flat braid, and round braid, without special limitation.

The weave fabric may be any of plain weave, eight-shaft satin weave, four-shaft satin weave, and twill weave, without special limitation, and also may be a so-called bias fabric. The weave fabric may even be a so-called, non-crimp weave fabric having substantially no bend, as described in JP-A-S55-30974.

The weave fabric is typically embodied in such a way that at least one of warp and weft is the commingled yarn of this invention. The other one of the warp and weft may be the commingled yarn of this invention, or may be a reinforcing fiber or thermoplastic resin fiber, depending on desired characteristics. As one case of using the thermoplastic resin fiber for the other one of the warp and weft, exemplified is a case of using a fiber which contains, as the main ingredient, a thermoplastic resin same as that composing the commingled yarn of this invention.

The product form of the knitted fabric is freely selectable from those obtained by any known way of knitting such as warp knitting, weft knitting, and raschel knitting, without special limitation.

The product form of non-weave fabric is not specifically limited, and is typically manufactured by chopping the commingled yarn of this invention to produce a fleece, and then mutually bonding the commingled yarn. The fleece may be formed by dry process or wet process. Chemical bonding, thermal bonding and so forth are usable for the mutual bonding of the commingled yarn.

The commingled yarn of this invention is also usable as a base in the form of tape or sheet in which the commingled yarn is oriented unidirectionally, braid, rope-like base, or stacks composed of two or more of these bases.

In addition, preferably used is a composite material obtained by stacking and then annealing the commingled yarn of this invention, braid, weave fabric, knitted fabric, non-weave fabric and so forth. The annealing may be implemented typically in the temperature range 10 to 30° C. higher than the melting point of the thermoplastic resin.

The formed article of this invention is suitably used, for example, for parts or housings of electric/electronic apparatuses such as personal computer, office automation apparatus, audio visual apparatus and mobile phone, optical apparatus, precision apparatus, toy, home/business electric appliances, and for parts of automobile, aircraft, vessel and so forth. The formed article is particularly suitable for manufacturing molded articles with recessed portions and projected portions.

EXAMPLE

This invention will be detailed more specifically referring to Examples. Materials, amounts of consumption, ratio, process details, process procedures and so forth are suitably modified without departing from the spirit of this invention. The scope of this invention is, therefore, not limited by the specific examples described below.

<Exemplary Synthesis of Polyamide Resin XD10>

In a reactor vessel equipped with a stirrer, a partial condenser, a total condenser, a thermometer, a dropping funnel, a nitrogen introducing pipe, and a strand die, placed were 12,135 g (60 mol), precisely weighed, of sebacic acid derived from castor oil bean, 3.105 g of sodium hypophosphite monohydrate ($NaH_2PO_2.H_2O$) (equivalent to 50 ppm of phosphorus atom in the polyamide resin), and 1.61 g of sodium acetate. After thorough replacement with nitrogen, nitrogen was filled up to an inner pressure of 0.4 MPa, and the reaction system was heated up to 170° C. while being stirred under a small amount of nitrogen gas flow. The molar ratio of sodium hypophosphite monohydrate/sodium acetate was set to 0.67.

To the content, 8,335 g (61 mol) of a 7:3 (molar ratio) mixture of metaxylylene diamine and paraxylylene diamine was added dropwise under stirring, and the reaction system was continuously heated while removing water released by condensation out of the system. After the dropwise addition of the mixed xylylene diamine, the inner temperature was set to 260° C. to continue the melt polymerization reaction for 20 minutes. Next, the inner pressure was recovered to the atmospheric pressure at a rate of 0.01 MPa/min.

The system was then pressurized again with nitrogen, the polymer was drawn out from the strand die, and pelletized to obtain approximately 24 kg of polyamide resin (XD10). The obtained pellet was dried at 80° C. with a dehumidified air (dew point=−40° C.) for one hour. XD10 was found to have a glass transition temperature (Tg) of 64° C.

XD6: Metaxylylene adipamide resin (Grade 56007, from Mitsubishi Gas Chemical Company, Inc.), number-average molecular weight=25000, content of component having weight-average molecular weight of 1000 or smaller=0.51% by mass, Tg=88° C.

N66: Polyamide resin 66 (AmilanCM3001, fromToray Industries, Inc.), Tg=50° C.

PC: Polycarbonate resin (Product No. 52000, from Mitsubishi Engineering-Plastics Corporation), Tg=151° C.

POM: Polyacetal resin (Product No. F20-03, from Mitsubishi Engineering-Plastics Corporation), Tg=−50° C.

CF: T700-12000-60E, from Toray Industries, Inc., 8000 dtex, the number of fibers=12000 f, surface treated with epoxy resin GF: glass fiber, from Nitto Boseki Co., Ltd., 1350 dtex, the number of fibers=800 f, surface treated with epoxy resin Water-soluble nylon: surface treatment agent for commingled yarn (Product No. AQ nylon T70, from Toray Industries, Inc.)

Epoxy resin: surface treatment agent for commingled yarn (Product No. EM-058, from ADEKA Corporation)

Water-insoluble nylon emulsion: surface treatment agent for commingled yarn (Product No. Sepolsion PA200, from Sumitomo Seika Chemicals Co., Ltd.)

<Fiber Making from Thermoplastic Resin>

The thermoplastic resin was made into fiber according to the procedures below.

The thermoplastic resin was melt extruded using a single-screw extruder having a 30 mm diameter screw, through a 60-hole die into strands, and the strands were taken up onto a roll while being drawn, to thereby obtain the thermoplastic resin fiber in the form of wound article. The melting temperature was set to 280° C. for polyamide resin, 300° C. for polycarbonate resin, and 210° C. for polyacetal resin.

Manufacture of Commingled Yarn

Examples 1 to 10

The continuous thermoplastic resin fiber and the continuous reinforcing fiber were respectively unwound from the wound articles, and were opened by allowing them to pass through a plurality of guides, under air blow. Concurrently with the opening, the continuous thermoplastic resin fiber and the continuous reinforcing fiber bundle were combined to form a single bundle. The bundle was further allowed to pass through a plurality of guides, and blown with air for further uniformization, to yield a blended fiber bundle.

The obtained blended fiber bundle was further dipped in an aqueous solution which contains the surface treatment agent summarized in Table for 10 seconds, and then dried at the drying temperature (° C.) for the drying time (min) respectively summarized in Table, to obtain the commingled yarn. The concentration of the aqueous surface treatment agent solution (for dispersion, the amount of solid matter relative to the solvent) was set to the value (in % by weight) summarized in Table below.

Manufacture of Commingled Yarn

Example 11

The continuous thermoplastic resin fiber was brought into contact with a metal plate at 160° C. for 40 seconds for preheating. The continuous thermoplastic resin fiber thus preheated and the continuous reinforcing fiber were respectively unwound from the wound articles, and were opened by allowing them to pass through a plurality of guides, under air blow. Concurrently with the opening, the continuous thermoplastic resin fiber and the continuous reinforcing fiber were combined to form a single bundle. The bundle was further allowed to pass through a plurality of guides, and blown with air for further uniformization, to yield a blended fiber bundle.

The obtained blended fiber bundle was further dipped in an aqueous solution which contains the surface treatment agent summarized in Table for 10 seconds, and then dried at the drying temperature (° C.) for the drying time (min) respectively summarized in Table, to obtain the commingled yarn.

Manufacture of Commingled Yarn

Comparative Example 1

The continuous thermoplastic resin fiber and the continuous reinforcing fiber were respectively unwound from the wound articles, and were opened by allowing them to pass through a plurality of guides, under air blow. Concurrently with the opening, the continuous thermoplastic resin fiber and the continuous reinforcing fiber bundle were combined to form a single bundle. The bundle was further allowed to pass through a plurality of guides, and blown with air for further uniformization, to yield a blended fiber bundle.

The product was further dipped in water which contains no surface treatment agent for 10 seconds, and then dried at the drying temperature for the drying time respectively summarized in Table, to obtain the commingled yarn of Comparative Example 1.

Manufacture of Commingled Yarn

Comparative Example 2

The continuous reinforcing fiber was dipped in chloroform, and cleaned by sonication for 30 minutes. The cleaned continuous reinforcing fiber was taken out, and dried at 60° C. for 3 hours. Next, the fiber was dipped in a methyl ethyl ketone solution which contains 30% by weight of bisphenol A glycidyl ether (DGEBA), and then dried at 23° C. for 10 minutes. The content of the surface treatment agent, etc. in the thus obtained continuous reinforcing fiber was found to be 2.1% by weight. The obtained continuous carbon fiber was taken up into a wound article. The continuous thermoplastic resin fiber and the continuous reinforcing fiber were respectively unwound from the wound articles, and were opened by allowing them to pass through a plurality of guides, under air blow. Concurrently with the opening, the continuous thermoplastic resin fiber and the continuous reinforcing fiber bundle were combined to form a single bundle. The bundle was further allowed to pass through a plurality of guides, and blown with air for further uniformization, to yield a blended fiber bundle.

The obtained blended fiber bundle was further dipped in an aqueous solution which contains the surface treatment agent, or in a dispersion of the surface treatment agent summarized in Table for 10 seconds, and then dried at the drying temperature (° C.) for the drying time (min) respectively summarized in Table, to obtain the commingled yarn.

<Measurement of Amounts of Surface Treatment Agent and Sizing Agent>

<<Continuous Reinforcing Fiber>>

Five grams (denoted as weight (X)) of the surface-treated continuous reinforcing fiber was dipped in 200 g of methyl ethyl ketone, so as to dissolve the surface treatment agent at 25° C. and wash the continuous reinforcing fiber. The fiber was then heated to 60° C. under reduced pressure to vaporize off methyl ethyl ketone, and the residue was collected for measurement of weight (Y). The amount of the surface treatment agent, etc. was calculated in the form of Y/X (% by weight). Also for the resin fiber, the amount of surface treatment agent, etc. may be measured in the same way as above.

<<Commingled Yarn>>

Five grams (denoted as weight (X)) of the commingled yarn was dipped in 200 g of methyl ethyl ketone, so as to dissolve the surface treatment agent at 25° C., and then washed by sonication. The fiber was then heated to 60° C. under reduced pressure to vaporize off methyl ethyl ketone, and the residue was collected for measurement of weight (Y). The amount of the surface treatment agent, etc. was calculated in the form of Y/X (% by weight).

<Measurement of Degree of Dispersion>

The dispersibility of the commingled yarn was measured by observation as explained below.

The commingled yarn was cut, embedded in an epoxy resin, and polished on a cross-sectional surface which intersects the commingled yarn, and a cross sectional view was photographed under a super-deep color 3D profile measurement microscope "VK-9500 (controller unit)/VK-9510 (measurement unit) (from Keyence Corporation). On the photographed image, the cross-sectional area of the commingled yarn; the total area, in the cross-sectional area of the commingled yarn, of domains occupied solely by the continuous reinforcing fiber with a spread of 31400 $\mu m^2$ or wider; and the total area, in the cross-sectional area of the commingled yarn, of domains occupied solely by the resin fiber with a spread of 31400 $\mu m^2$ or wider were determined, and the dispersibility was calculated using the equation below.

$$D\ (\%)=(1-(Lcf+Lpoly)/Ltot)*100 \qquad \text{[Mathematical Formula 1]}$$

(in the formula, D represents the dispersibility, Ltot represents the cross-sectional area of the commingled yarn, Lcf represents the total area, in the cross-sectional area of the commingled yarn, of domains occupied solely by the continuous reinforcing fiber with a spread of 31400 $\mu m^2$ or wider, and Lpoly represents the total area, in the cross-sectional area of the commingled yarn, of domains occupied solely by the resin fiber with a spread of 31400 $\mu m^2$ or wider. The cross section of the commingled yarn was measured on a piece obtained by cutting the commingled yarn vertically to the longitudinal direction thereof. The area was measured using a digital microscope.)

<Measurement of Void Ratio>

A cross section of the commingled yarn, taken in the thickness wise direction, was observed and the void ratio was measured as described below. The commingled yarn was cut vertically to the longitudinal direction of fiber, fixed on a stand so as to direct the fibers unidirectionally, and a resin was cast thereon to embed them under reduced pressure. The commingled yarn was then polished on a cross section thereof taken vertically to the longitudinal direction of fiber, and a region represented by the thickness of commingled yarn×500 μm in width was photographed under a super-deep color 3D profile measurement microscope "VK-9500 (controller unit)/VK-9510 (measurement unit) (from Keyence Corporation) at a 400× magnification. The captured image was visually observed to determine the void portions and to find the area thereof, and void ratio was calculated using the equation below.

$$\text{Void ratio}\ (\%)=100\times(\text{area of void portions})/(\text{cross sectional area of commingled yarn})$$

<Measurement of Amount of Falling>

Impact was applied on the commingled yarn to promote falling of fiber, and the sizability was evaluated based on changes in weight of the commingled yarn before and after the impact application. It was defined as below: (Amount of falling of fiber)=(Pre-impact weight of commingled yarn)−(Post-impact weight of commingled yarn), where it was judged that the smaller the amount of falling, the better the sizability.

Figure 2:
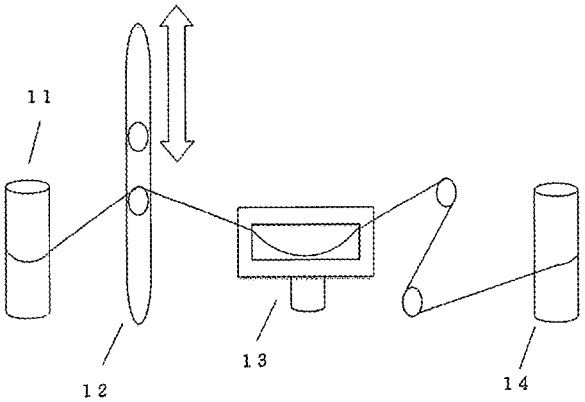
FIG. 2 A schematic drawing of an apparatus used for measuring the amount of falling in embodiments of this invention.

A measurement apparatus used here was a testing device (from Kaji Group Co., Ltd.) illustrated in FIG. 2. Using the device, implemented were a series of operations which include a step 11 of unwinding the commingled yarn; a step 12 of vigorously and vertically agitating rollers between which the commingled yarn is allowed to pass, so as to apply impact thereon; a suction step 13 which promotes falling of fine fibers produced under impact; and a winding step 14. The speed of winding was set to 3 m/min, the width of stroke of the impacted portion was set to 3 cm, the impact velocity was set to 800 rpm, and the length of sample yarn was set to 1 m. Values were given in g/m.

<Manufacture of Weave Fabric>

The thermoplastic resin fiber bundle was manufactured according to the method of fiber making of the thermoplastic resin. The obtained thermoplastic resin fiber bundle had the number of fibers of 34 f, and a fineness of 110 dtex.

Using the commingled yarn obtained above as the warp, and the thermoplastic resin fiber bundle as the weft, a fabric was woven using a rapier loom. The weave fabric was controlled to be 720 $g/m^2$ in base weight. Combinations of the warp and weft were summarized in Table below.

<Manufacture of Molded Article>

The obtained weave fabrics were stacked, and hot-pressed at a temperature 20° C. higher than the melting point of the thermoplastic resin fiber which composes the warp. A 2 mm (t)×10 cm×2 cm test piece was cut out from the obtained molded article.

<Tensile Modulus>

Tensile modulus of the molded article thus obtained was tested according to JIS K7127 and K7161, to determine tensile modulus (MPa). The apparatus used here was Strograph from Toyo Seiki Seisaku-Sho Ltd., while setting the width of test piece to 10 mm, the chuck-to-chuck distance to 50 mm, and the tensile speed to 50 mm/min, at a measurement temperature of 23° C., and measurement humidity of 50% RH. Values were given in GPa.

<Tensile Strength>

Tensile strength of the molded article thus obtained was measured according to the method described in ISO 527-1 and ISO 527-2, under conditions including a measurement temperature of 23° C., a chuck-to-chuck distance of 50 mm, and a tensile velocity of 50 mm/min. Values were given in MPa.

TABLE 1

| | | Example 1 | Example 2 | Example 3 | Example 4 | Example 5 | Example 6 | Example 7 |
|---|---|---|---|---|---|---|---|---|
| Source fibers of commingled yarn | Reinforcing fiber | CF | CF | CF | CF | CF | CF | CF |
| | Resin fiber | XD10 | XD10 | XD10 | XD10 | XD6 | N66 | PC |
| Weft yarn of fabric | Resin fiber | XD10 | XD10 | XD10 | XD10 | XD6 | N66 | PC |
| Surface treatment agent for reinforcing fiber | | Epoxy resin | Epoxy resin | Epoxy resin | Epoxy resin | Epoxy resin | Epoxy resin | Epoxy resin |
| Conditions for applying surface treatment agent for blended fiber bundle | Surface treatment agent | Water-soluble nylon | Water-soluble nylon | Water-soluble nylon | Epoxy resin | Water-soluble nylon | Water-soluble nylon | Epoxy resin |
| | Concentration of surface treatment agent | 1.7 | 3.7 | 4.6 | 1.5 | 1.7 | 1.7 | 1.5 |
| Conditions for drying blended fiber bundle | Drying temperature | 40 | 40 | 40 | 60 | 40 | 40 | 60 |
| | Drying time | 60 | 60 | 60 | 45 | 60 | 60 | 45 |
| Amount of surface treatment agent | Blended fiber bundle | 0.4 | 0.4 | 0.4 | 0.4 | 0.4 | 0.4 | 0.4 |
| | Commingled yarn | 2.2 | 4.1 | 5.2 | 2 | 2.3 | 2.4 | 2.1 |
| Physical properties of commingled yarn | Dispersibility | 89 | 89 | 89 | 89 | 87 | 92 | 87 |
| | Void ratio | 15 | 15 | 15 | 16 | 18 | 18 | 16 |
| | Amount of falling | 0 | 0 | 0 | 1.4 | 0 | 0 | 1.3 |
| Physical properties of woven fabric | Tensile modulus | 110 | 110 | 105 | 103 | 115 | 105 | 105 |
| | Tensile strength | 1850 | 1869 | 1545 | 1780 | 1980 | 1790 | 1440 |

| | | Example 8 | Example 9 | Example 10 | Example 11 | Comparative Example 1 | Comparative Example 2 |
|---|---|---|---|---|---|---|---|
| Source fibers of commingled yarn | Reinforcing fiber | CF | GF | CF | CF | CF | CF |
| | Resin fiber | POM | XD6 | XD10 | XD10 | XD10 | XD10 |
| Weft yarn of fabric | Resin fiber | POM | XD6 | XD10 | XD10 | XD10 | XD10 |
| Surface treatment agent for reinforcing fiber | | Epoxy resin | Epoxy resin | Epoxy resin | Epoxy resin | Epoxy resin | Epoxy resin |
| Conditions for applying surface treatment agent for blended fiber bundle | Surface treatment agent | Epoxy resin | Silane coupling agent | Nylon emulsion | Water-soluble nylon | None (water) | Water-soluble nylon |
| | Concentration of surface treatment agent | 10 | 10 | 3.0 | 3.7 | 0 | 1.7 |
| Conditions for drying blended fiber bundle | Drying temperature | 60 | 60 | 40 | 80 | 40 | 40 |
| | Drying time | 45 | 45 | 60 | 20 | 60 | 60 |
| Amount of surface treatment agent | Blended fiber bundle | 0.4 | 1.2 | 0.4 | 0.4 | 0.4 | 2.1 |
| | Commingled yarn | 10 | 6.4 | 3.4 | 5.1 | 0.4 | 3.9 |
| Physical properties of commingled yarn | Dispersibility | 84 | 84 | 89 | 89 | Not measurable | 32 |
| | Void ratio | 18 | 17 | 19 | 15 | | 19 |
| | Amount of falling | 0.5 | 0.3 | 2.1 | 0 | | 0 |
| Physical properties of woven fabric | Tensile modulus | 95 | 38 | 107 | 111 | | 85 |
| | Tensile strength | 1370 | 1130 | 1841 | 1855 | | 1330 |

As is clear from the results above, the commingled yarns of this invention (Examples 1 to 11) showed high levels of dispersibility of the continuous thermoplastic resin fiber and the continuous reinforcing fiber, low levels of void ratio, and small amounts of falling of fiber. The molded articles molded from the commingled yarn were found to show high levels of tensile modulus and tensile strength.

In contrast, the blended fiber bundle, having not re-treated with the surface treatment agent (Comparative Example 1), did not suitably form a bundle, so that the void ratio of the commingled yarn was not measurable. Such commingled yarn was also found to be less handleable, and was suitably woven to give weave fabric only with difficulty.

The blended fiber bundle, having the content of the surface treatment agent of exceeding 2.0% by mass (Comparative Example 2), was found to degrade the dispersibility of the continuous thermoplastic resin fiber and the continuous reinforcing fiber, even if re-treated with the surface treatment agent.

Figure 3:
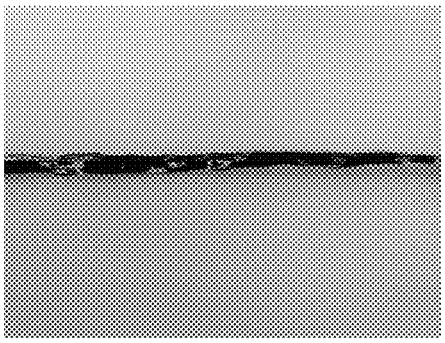
FIG. 3 A photo illustrating a result of observation of the commingled yarn according to Example 1 of this invention.

FIG. 3 is a photo illustrating a result of observation of the commingled yarn of Example 1. A tape-like product of approximately 8 mm wide and approximately 0.4 mm thick at the maximum was obtained. The individual fibers were found to be suitably aligned.

Figure 4:
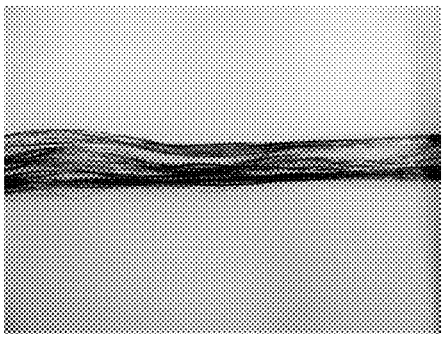
FIG. 4 A photo illustrating a result of observation of the commingled yarn according to Comparative Example 1 of this invention.

FIG. 4 is a photo illustrating a result of observation of the commingled yarn of Comparative Example 1. The continuous thermoplastic resin fiber and the continuous carbon fiber were found to be loosened, as compared with FIG. 3.

REFERENCE SIGNS LIST

1 Roll having commingled yarn taken up thereon
2 Liquid containing surface treatment agent and/or sizing agent
3 Drying zone
4 Roll having commingled yarn taken up thereon
5 Wringing step
11 Step of unwinding commingled yarn
12 Step of vigorously and vertically agitating rollers between which commingled yarn is allowed to pass, so as to apply impact on commingled yarn
13 Suction step for promoting falling of fine fibers produced under impact
14 Winding step

What is claimed is:

1. A commingled yarn comprising:

a blended fiber bundle; and a surface treatment agent and/or sizing agent of the commingled yarn, wherein the blended fiber bundle includes a continuous thermoplastic resin fiber, a continuous reinforcing fiber, and a portion of epoxy resin as a surface treatment agent and/or sizing agent of the continuous reinforcing fiber in an amount of 0.4 to 1.2% by weight, relative to a total amount of the continuous thermoplastic resin fiber and the continuous reinforcing fiber in the blended fiber bundle, wherein a total amount of the surface treatment agent and/or sizing agent in the commingled yarn is 2.1% to 10% by weight, relative to a total amount of the continuous thermoplastic resin fiber and the continuous reinforcing fiber, and the commingled yarn has a dispersibility of the continuous thermoplastic resin fiber and the continuous reinforcing fiber of 70% or larger, wherein the continuous thermoplastic resin is selected from the group consisting of mixed polymetaxylylene/paraxylylene sebacamide resin, polymetaxylylene adipamide resin, polyamide 66, and combinations thereof;

wherein the surface treatment agent and/or sizing agent of the commingled yarn is water-soluble nylon; and wherein the continuous reinforcing fiber is a carbon fiber and/or glass fiber.

2. The commingled yarn of claim 1, having a void ratio of 20% or smaller.

3. The commingled yarn of claim 1, wherein the continuous thermoplastic resin fiber contains at least polyamide 66.

4. The commingled yarn of claim 1, wherein the surface treatment agent and/or sizing agent has a content of 2.0 to 10% by weight, relative to a total amount of the continuous thermoplastic resin fiber and the continuous reinforcing fiber.

5. A method for manufacturing a commingled yarn, the method comprising immersing a blended fiber bundle into a liquid containing a surface treatment agent and/or sizing agent, followed by drying, wherein the blended fiber bundle comprises a continuous thermoplastic resin fiber, a continuous reinforcing fiber, and a surface treatment agent and/or sizing agent of the continuous reinforcing fiber;

a portion of epoxy resin as the surface treatment agent and/or sizing agent of the continuous reinforcing fiber has a content of 0.4 to 1.2% by weight, relative to a total amount of the continuous thermoplastic resin fiber and the continuous reinforcing fiber in the blended fiber bundle; and wherein a total amount of a surface treatment agent and/or sizing agent in the commingled yarn is 2.1% to 10% by weight, relative to a total amount of the continuous thermoplastic resin fiber and the continuous reinforcing fiber, and the commingled yarn has a dispersibility of the continuous thermoplastic resin fiber and the continuous reinforcing fiber of 70% or larger, wherein the continuous thermoplastic resin is selected from the group consisting of mixed polymetaxylylene/paraxylylene sebacamide resin, polymetaxylylene adipamide resin, polyamide 66, and combinations thereof;

wherein the surface treatment agent and/or sizing agent of the commingled yarn is water-soluble nylon; and wherein the continuous reinforcing fiber is a carbon fiber and/or glass fiber.

6. The method for manufacturing a commingled yarn of claim 5, wherein the commingled yarn has a void ratio of 20% or smaller.

* * * * *